US005302089A

United States Patent [19]

Maruyama et al.

[11] Patent Number: 5,302,089

[45] Date of Patent: Apr. 12, 1994

[54] FLUID ROTATING APPARATUS

[75] Inventors: Teruo Maruyama, Hirakata; Akira Takara, Moriguchi; Yoshikazu Abe, Neyagawa, all of Japan

[73] Assignee: Matsushita Electric Industrial Co., Ltd., Osaka, Japan

[21] Appl. No.: 957,787

[22] Filed: Oct. 8, 1992

[30] Foreign Application Priority Data

Oct. 8, 1991 [JP] Japan ..... 3-260005

[51] Int. Cl.[5] ..... F04B 23/08

[52] U.S. Cl. ..... 417/199.1; 417/203; 417/205

[58] Field of Search ..... 417/199.1, 200, 201, 417/202, 203, 205, 423.1, 423.4, 310, 338; 418/201.1; 415/89, 90

[56] References Cited

U.S. PATENT DOCUMENTS

| | | | |
|---|---|---|---|
| Re. 17,689 | 6/1930 | Hibbard . | |
| 2,243,874 | 6/1941 | Lysholm | 418/201.1 |
| 2,640,428 | 5/1949 | Houghton . | |
| 3,639,087 | 2/1972 | Frohbieter | 417/203 |
| 3,811,805 | 5/1974 | Moody, Jr. et al. | 417/410 |
| 4,152,092 | 5/1979 | Swearingen | 415/53 R |
| 4,420,291 | 12/1983 | Winstead | 417/338 |
| 4,625,156 | 11/1986 | Komiya et al. | 318/85 |
| 4,712,048 | 12/1987 | Rebsamen | 318/85 |
| 4,758,132 | 7/1988 | Hartwig | 417/353 |
| 4,797,068 | 1/1989 | Hayakawa et al. | 417/201 |
| 4,808,077 | 2/1989 | Kan et al. | 417/2 |
| 4,829,217 | 5/1989 | Kameyama et al. | 318/51 |
| 4,850,806 | 7/1989 | Morgan et al. | 417/53 |
| 5,062,771 | 11/1991 | Satou et al. | 417/201 |
| 5,115,172 | 5/1992 | Ishii et al. | 318/38 |
| 5,118,251 | 6/1992 | Saulgeot | 417/203 |
| 5,166,566 | 11/1992 | Bernhardt et al. | 417/423.4 |
| 5,197,861 | 3/1993 | Maruyama et al. | 417/203 |

FOREIGN PATENT DOCUMENTS

| | | | |
|---|---|---|---|
| 0221003 | 5/1987 | European Pat. Off. . | |
| 0256234 | 6/1987 | European Pat. Off. . | |
| 0230868 | 8/1987 | European Pat. Off. . | |
| 0340685 | 4/1989 | European Pat. Off. . | |
| 0382029 | 8/1990 | European Pat. Off. . | |
| 0435291 | 12/1990 | European Pat. Off. . | |
| 2163474 | 6/1973 | Fed. Rep. of Germany . | |
| 3230550 | 1/1984 | Fed. Rep. of Germany . | |
| 60-259791 | 12/1985 | Japan . | |
| 1-155089 | 6/1989 | Japan | 418/201.1 |
| 809445 | 2/1959 | United Kingdom . | |
| 2123089 | 1/1984 | United Kingdom . | |

OTHER PUBLICATIONS

"A Generalized Performance Computer Program for Oil Flooded Twin-Screw Compressor", Pawan J.

(List continued on next page.)

*Primary Examiner*—Richard A. Bertsch
*Assistant Examiner*—Alfred Basichas
*Attorney, Agent, or Firm*—Wenderoth, Lind & Ponack

[57] ABSTRACT

A fluid rotating apparatus of a positive displacement type pump includes a plurality of rotors accommodated in a housing, a bearing for rotatably supporting the rotors, a suction port and a discharge port formed in the housing, a plurality of motors for individually rotating the rotors, a detector for detecting rotating angles and rotating speeds of the motors, a synchronous controller for controlling rotation of the plurality of motors by a signal from the detector, and a transporting member coaxially provided on one of the rotors and on the upstream side thereof. The transporting member includes a rotary disk rotatable together with the rotor and a fixed disk opposed to the rotary disk fixed to the housing so as to maintain a gap between the rotary disk and the fixed disk. A spiral groove is formed on one of a surface of the rotary disk and an opposing surface of the fixed surface so as to transport one of fluid and gas molecules in a radial direction of the rotor between the rotary disk and the fixed disk. In this manner, fluid (i.e., liquid or gas) molecules are sucked and discharged due to a capacity change of a space defined by the rotors and the housing through synchronous control by the synchronous controller.

6 Claims, 9 Drawing Sheets

OTHER PUBLICATIONS

Singh and Ghanshyam C. Patel, Ingersoll-Rand Research, Inc. Princeton, N.J., 1984, pp. 544–553.

"Computer Modeling for Performance Analysis of Rotary Screw Compressor" Mitsuru Fujiwara and Katsuhiko Kasuya, Mechanical Engineering Research Laboratory, Hitachi, Ltd., Ibaraki, Japan, 1984, pp. 536–543.

"A New Molecular Pump", Louise Maurice, Proc. 6th Internl. Vacuum Congr. 1974, Japan, J. Appl. Phys. Suppl. 2, P1 1, 1974.

Patent Abstracts of Japan "Multichannel Type Vacuum Pump", vol. 13, No. 225 (M-830) [3573], May 25, 1989.

FLUID ROTATING APPARATUS

BACKGROUND OF THE INVENTION

The present invention relates to a fluid rotating apparatus such as a vacuum pump, a compressor, or the like.

FIG. 13 shows an example of a conventional sliding vane vacuum pump provided with only one rotor. In the vacuum pump with one rotor, when the rotor 101 rotates, two blades 102 inserted in the rotor 101 in the diametrical direction of the rotor 101 are driven and rotated inside a cylindrical fixed wall 103 (stator). At this time, the leading ends of the blades 102 are kept in contact with the fixed wall since the blades 102 are always urged in the radical direction of the rotor 101 by the action of a spring 104. Subsequent to the rotation, the capacity of each of the spaces 105 partitioned by the blades 102 in the fixed wall is changed, and a gas entering from a suction port 106 formed at the fixed wall is eventually sucked and compressed and flows out through a discharge port 107 having a discharge valve In the vacuum pump of this type, in order to prevent internal leakage, it is necessary to seal the side surface and the leading ends of the blades 102, the side surface of the fixed wall 103, and the side surface of the rotor 101 with oil membranes, respectively. However, when this kind of vacuum pump is used in the manufacturing process of semiconductors, e.g., CVD or dry etching, etc. using a highly corrosive reactive gas such as chlorine gas, the gas reacts with the sealing oil to thereby generate a reaction product in the pump. In this situation, it becomes necessary to perform maintenance work frequently so as to remove the reaction product, and moreover, the pump should be cleaned and the oil should be exchanged every time maintenance work is performed, thus bringing the manufacturing process to a halt. The activity rate is hence decreased. So long as the sealing oil is used in the vacuum pump, the oil is scattered from the downstream side to the upstream side, polluting the vacuum chamber and deteriorating the manufacturing efficiency.

In view of the above-described inconveniences, a positive displacement type screw vacuum pump has been developed and put into practical use as a dry pump which does not require the sealing oil. FIG. 14 is a side sectional view of an example of such screw vacuum pump. Within a housing 111 are provided two rotors 112, the rotary shafts of which are made parallel to each other. Spiral grooves are formed on the peripheral surfaces of the rotors 112. A space is defined when a recess portion (groove) 113*a* of one rotor and a projection 113*b* of the other rotor are meshed with each other. Thus, as the rotors 112 rotate, the capacity of the space changes, to cause sucking and discharging of the fluid.

In addition to the positive displacement type vacuum pump, a turbo type vacuum pump as shown in FIG. 15 has been developed.

The turbo type vacuum pump comprises a rotary shaft 150, a motor 15, ball bearings 152*a* and 152*b*, and a housing 153. A plurality of rotary disks 154 arranged in multiple stages is provided on the rotary shaft 150 and a spiral groove is formed on each of the surfaces of the rotary disks 154. An opposed surface 155 is formed on the fixed side of the pump, with a small gap provided therebetween to cause suction and discharge of the gas due to molecular drag operation of the spiral groove caused by the high speed rotation of the rotary shaft 150.

The positive displacement type vacuum pump and the turbo type vacuum pump have the following disadvantages:

In the conventional positive displacement type screw vacuum pump referred to above and shown in FIG. 14, the synchronous rotation of the rotors 112 is achieved by timing gears. That is, the rotation of a motor 115 is transmitted from a driving gear 116*a* to an intermediate gear 116*b* and further to one of the meshed timing gears 116*c* of the rotors 112. The phase of the rotating angles of both rotors 112 is adjusted by the engagement between the two timing gears 116*c*. Therefore, since the screw vacuum pump uses the gears both for transmission of the motor power and for synchronous rotation of the rotors as described hereinabove, a lubricating oil filled in a machine chamber 117 which houses the gears must be supplied to the gears. Moreover, a mechanical seal 119 should be provided between the machine chamber 117 and a fluid chamber 118 so as to prevent the lubricating oil from entering the chamber 118 where the rotors are accommodated.

The vacuum pump with two rotors in the above-described construction has disadvantages yet to be solved, in that (1) many gears are required for the power transmission and the synchronous rotation, i.e., many parts are required, resulting in a complicated structure of the apparatus, (2) a high speed operation cannot be expected and the apparatus is bulky in size since the rotors are synchronously rotated due to the contact maintained between the gears, (3) a mechanical seal must be regularly exchanged due to the abrasion thereof, such that a completely maintenance-free pump is not realized, (4) a large sliding torque due to the mechanical seal induces large mechanical losses, and so on.

Unlike the screw vacuum pump having two rotors, the turbo type vacuum pump has one rotor, namely, one rotary shaft. Accordingly, the rotary shaft can be driven at a high speed because the turbo type vacuum pump has no sliding mechanism allowing the two shafts to synchronously rotate. A clean dry pump can constituted by supplying lubricating oil to only the bearing section and providing a sealing section for preventing the penetration of the oil into the pump section.

Since the drag operation of the spiral groove allows the discharge performance of the pump to range from a viscous flow region to a molecular flow region, a vacuum can be generated to a degree of $10^{-5}$ torr.

As apparent from the graph of FIG. 4 showing, by a conventional example (1), characteristic data of the relationship between discharge speed and inlet pressure, in this kind of pump, i.e., the pump in FIG. 14, utilizing the molecular drag operation, the discharge speed is reduced to a great extent when the inlet pressure is in the range between atmospheric pressure and an intermediate degree of vacuum ($10-3$ to $10^0$ torr).

The generation of heat which occurs in the pump section in the above-described range of the inlet pressure makes it difficult to achieve continuous operation of the pump. As a result, the discharge period of time is long, which deteriorates the operational efficiency of the pump used in a semiconductor plant.

SUMMARY OF THE INVENTION

In view of the above-described situation, there has been provided a fluid rotating apparatus (as disclosed in Ser. No. 07/738,902, filed on Aug. 1, 1991, in the name of Teruo MARUYAMA et al.) which includes plural rotors driven by independent motors so that the rotation of the motors is synchronously controlled by the synchronous rotation of the rotors without any contact therebetween by using rotary encoders to detect the rotary angles and number of rotations of the rotors. The apparatus can be operated with high speed rotation of the rotors, eliminates the need for maintenance, and can be easily cleaned and miniaturized.

An object of the present invention is to provide a fluid rotating apparatus which enables high speed rotation of the rotors, eliminates the need for maintenance, can be easily cleaned and miniaturized, can be shortened in size and which improves the above proposed apparatus so as to obtain a lower vacuum pressure by preventing its discharge capacity from decreasing over a wider inlet pressure range.

In accomplishing these and other objects, according to one aspect of the present invention, there is provided a fluid rotating apparatus of a positive displacement type which comprises: a plurality of rotors accommodated in a housing; a bearing for rotatably supporting the rotors; a suction port and a discharge port formed in the housing; a plurality of motors for individually rotating the rotors; a detecting means for detecting rotating angles and numbers of rotations per minute (i.e., rotating speed) of the motors; a synchronous control means for controlling rotation of the plurality of motors on the basis of a signal from the detecting means; and a transporting means coaxially provided on one of the rotors and on the upstream side thereof. The transporting means includes a rotary disk rotatable together with the rotor and a fixed disk opposed to the rotary disk fixed to the housing to maintain a gap between the rotary disk and the fixed disk. A spiral groove is formed on one of a surface of the rotary disk and an opposing surface of the fixed surface so as to transport fluid (i.e., liquid or gas) molecules in a radial direction of the rotor between the rotary disk and the fixed disk. In this manner, the fluid or gas molecules are sucked and discharged due to a capacity change of a space defined by the rotors and the housing through synchronous control by the synchronous control means.

The rotors are driven by independent motors and the control of the synchronous rotation of the rotors is carried out by the noncontact type rotation based on the synchronous control means. Thus, it is unnecessary to use gears used for power transmission and lubricating oil, and thus the high-speed operation of the apparatus can be achieved. The transport means serving as a centrifugal element type vacuum pump is provided coaxially with at least one of the rotors of the displacement type vacuum pump and on the upstream side of the rotor. As a result, both the centrifugal element type vacuum pump and the displacement type vacuum pump can be miniaturized.

In addition, the pump can be operated in a region of a high degree of vacuum by using a drag pump having a spiral groove formed therein as the centrifugal element type vacuum pump.

Since the displacement type vacuum pump can be of a screw type, fluid or gas molecules flow continuously, the influence of the internal leakage of fluid or gas molecules is small, and a large space can be formed in the rotor. The space can be utilized as a space for accommodating the bearing or the motor, which contributes to the miniaturization of the apparatus.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE PREFERRED EMBODIMENTS

Figure 1:
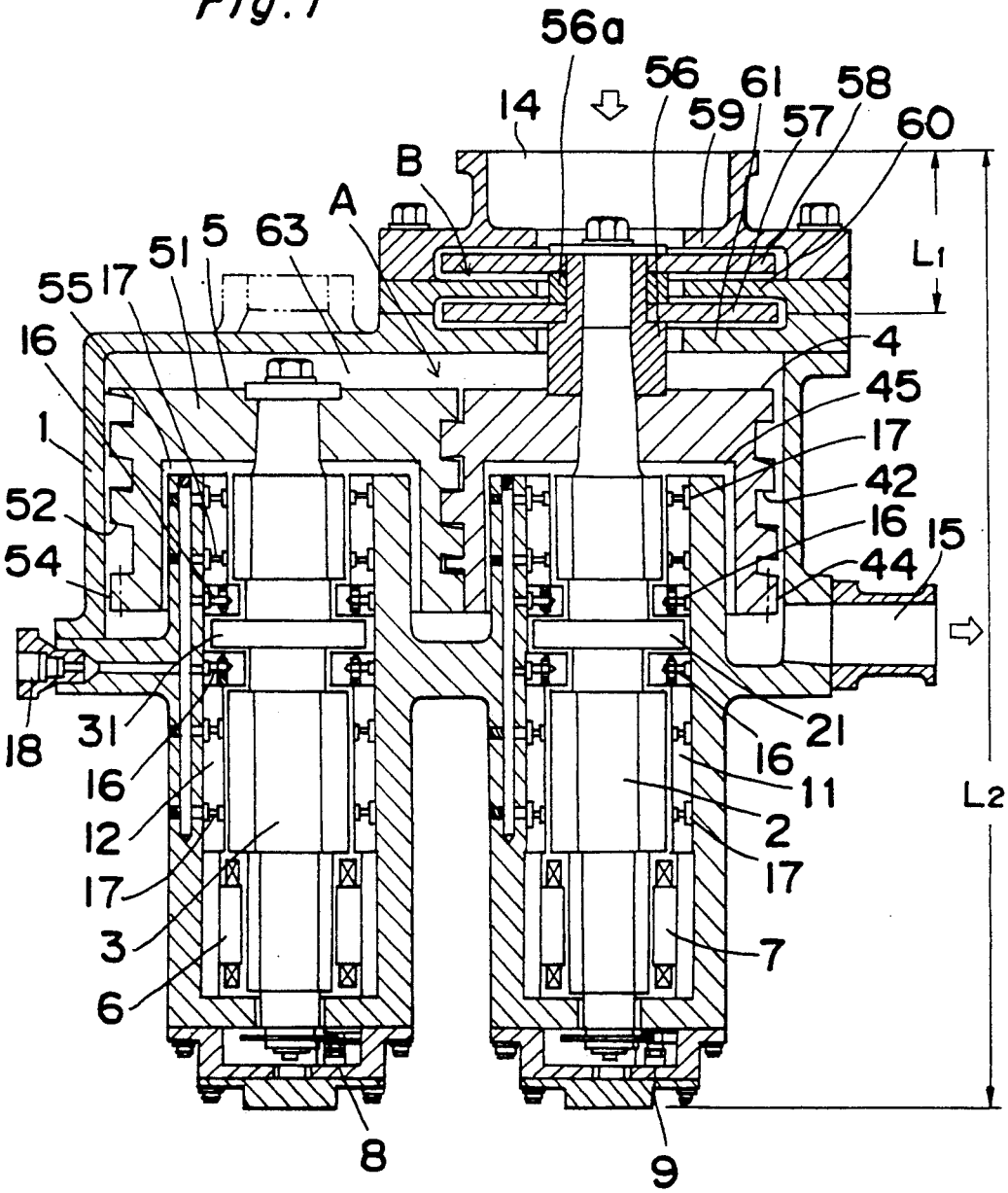
FIG. 1 is a sectional view showing a displacement type vacuum pump as a fluid rotating apparatus according to a first embodiment of the present invention.
Figure 2:
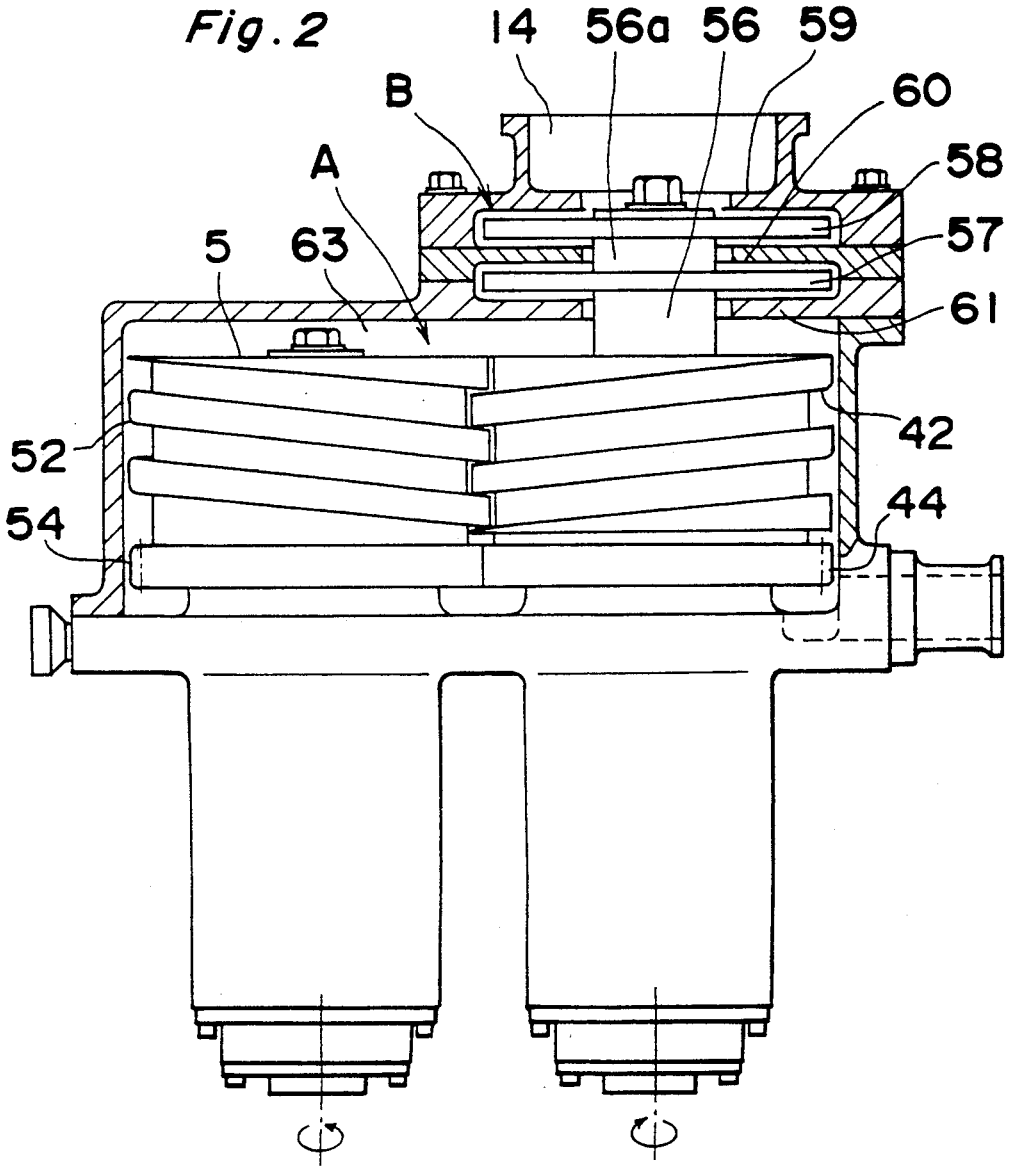
FIG. 2 is a partially cut away side elevation view showing the pump in FIG. 1.

Before the description of the present invention proceeds, it is to be noted that like parts are designated by like reference numerals throughout the accompanying drawings.

FIG. 1 illustrates a positive displacement type vacuum pump as a first embodiment of a fluid rotating apparatus according to the present invention. The vacuum pump has a first bearing chamber accommodating a first rotary shaft 2 in a vertical direction within a housing and a second bearing chamber 12 accommodating a second rotary shaft 3 in the same vertical direction. Cylindrical rotors 4 and 5 are fitted from outside at the upper ends of the rotary shafts 2 and 3. Spiral grooves 42 and 52 are formed at the outer peripheral surfaces of the rotors 4 and 5 in a manner to be meshed with each other. The section defined when the spiral grooves are meshed constitutes a structural part of the positive displacement type vacuum pump. That is, a space between a recessed portion (groove) and a projecting portion of the engaged spiral grooves 42 and 52 and the housing 1 periodically changes its capacity in accordance with the rotation of the rotary shafts 2 and 3, thereby acting to suck/discharge the fluid.

Rotary disks 57 and 58 are installed on the first rotary shaft 2 at an upper portion thereof through a bushing 56. A spacer 56a is installed between the rotary disks 57 and 58 through the bushing 56 to maintain a space between the rotary disks 57 and 58. Fixed disks 59, 60, and 61 are mounted on the housing 1 on the fixed side thereof in opposition to the rotary disk 58, the bushing 56, and the rotary disk 57, respectively, with small gaps provided therebetween. The small gaps are continuously connected from the suction port 14 to a space 63 in the housing 1 to allow the fluid to flow therethrough.

Figure 3A:
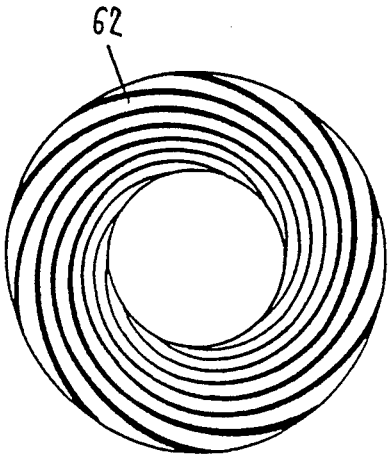
FIG. 3A is a plan view showing a spiral groove formed on a surface of a rotary disk in a structural part of a centrifugal element type pump of FIG. 1.

A spiral groove 62 is formed on each surface of each of the rotary disks 57 and 58 as shown in FIG. 3A. The fixed disks 59, 60, and 61, the rotary disks 57 and 58, the bushing 56, and the spacer 56a constitute a structural part of a centrifugal element type vacuum pump so that fluid or gas molecules can be sucked and discharged through the small gaps due to a molecular drag operation between the spiral grooves 62 of the upper and lower surfaces of the rotary disks 57 and 58 and the opposing surfaces of the fixed disks 59, 60, and 61 caused by the high speed rotation of the rotary shaft 2. The centrifugal element type vacuum pump is a vacuum pump which functions to transport fluid or gas molecules in a radial direction of the rotary shaft 2, i.e., a direction from the outside towards the center of the rotary shaft 2 or vice versa in the radial direction, between the surfaces of the rotary and fixed disks. The drag operation of the spiral grooves 62 causes the gas which has flowed from the suction port 14 into the housing 1 to be discharged to the space 63 accommodating the structural portion of the positive displacement type screw vacuum pump. Then, the gas is discharged through the discharge port 15.

Figure 5:
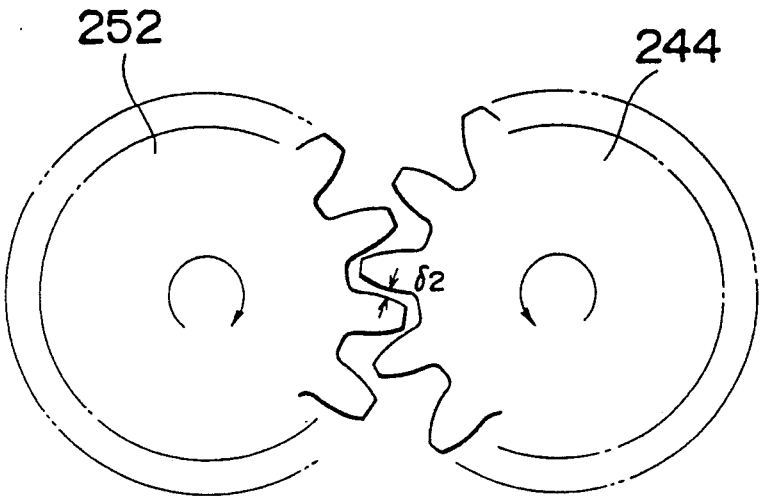
FIG. 5 is a plan view of a contact preventing gear used in the first embodiment

There are contact preventing gears 44 and 54 as shown in FIG. 5 which function to prevent contact between the spiral grooves 42 and 52 on the outer peripheral surfaces at the lower ends of the rotors 4 and 5, respectively. A solid lubricating film is formed on each contact preventing gear 44 and 54 so that it can withstand some metallic contact. A gap (backlash) $\delta_2$ formed when the contact preventing gears 44 and 54 are meshed with each other is set smaller than a gap (backlash) $\delta_1$ between the spiral grooves on the outer peripheral surfaces of the rotors 4 and 5. Therefore, when the rotary shafts 2 and 3 are rotated smoothly and synchronously, the contact preventing gears 44 and 54 are never brought in touch with each other. However, if the synchronous rotation of the rotary shafts 2 and 3 is broken, the contact preventing gears 44 and 54 are turned in contact with each other before the spiral grooves 42 and 52 contact with each other, thereby preventing contact and collision between the spiral grooves 42 and 52. If the backlashes $\delta_1$ and $\delta_2$ are minute gaps, it may be difficult to process the members of the apparatus accurately at a useful level. However, the total amount of the fluid which leaks during one stroke of the pump is proportional to the time period of the one stroke, and therefore, the performance of the pump (ultimate degree of vacuum) can be sufficiently maintained even if the backlash $\delta_1$ between the spiral grooves 42 and 52 is increased a little so long as the rotary shafts 2 and 3 are rotated at high speeds. Accordingly, in the vacuum pump of the embodiment wherein the rotary shafts 2 and 3 are rotated at high speeds, the backlashes $\delta_1$ and $\delta_2$ of the size required to prevent the collision of the spiral grooves 42 and 52 can be readily obtained with normal processing accuracy.

In the housing 1, the suction port 14 is provided on the upstream side of the structural part of the positive displacement type vacuum pump, and the discharge port 15 is provided in the downstream side thereof.

The first rotary shaft 2 and the second rotary shaft 3 are supported by non-contact type (contactless) hydrostatic bearings provided in the internal spaces 45 and 55 of the cylindrical rotors 4 and 5. More specifically, thrust bearings are constituted by supplying a compressed gas to the upper and lower surfaces of disk-like parts 21, 31 of the rotary shafts 2 and 3 from orifices 16. On the other hand, radial bearings are constituted by supplying a compressed gas to the outer peripheral surfaces of the rotary shafts 2 and 3 from orifices 17. In this case, when clean nitrogen gas generally kept in semiconductor plants is used as the compressed gas, the pressure inside the internal spaces 45 and 55 accommodating the motors 6 and 7 can be made higher than the atmospheric pressure, whereby a reactive gas which is corrosive and liable to produce deposit is prevented from entering the internal spaces 45 and 55.

The bearings may be magnetic bearings instead of the hydrostatic bearings described above, and since the magnetic bearings, like the hydrostatic bearings, are contactless, high speed rotation can be easily achieved and a completely oil-free construction can be realized. When a ball bearing is used in the bearing and a lubricating oil is used for lubrication of the bearing, it is possible to prevent the lubricating oil from entering the fluid operation chamber by use of a gas purge mechanism utilizing the nitrogen gas.

The first rotary shaft 2 and the second rotary shaft 3 are rotated at high speeds of several tens of thousands of rotations per minute by the AC servo-motors 6 and 7 provided in the lower part of the respective shafts.

Figure 7:
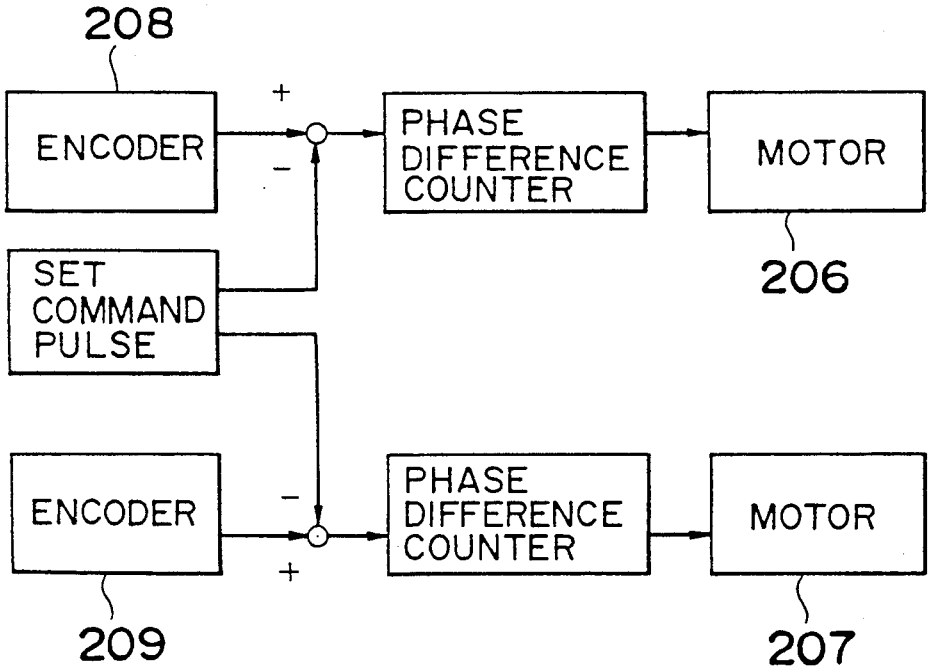
FIG. 7 is a block diagram showing a method of synchronously controlling the pump.

According to the instant embodiment, the two rotary shafts are controlled to be synchronously rotated in a manner as depicted by a block diagram shown in FIG. 7. In other words, there are provided rotary encoders 8 and 9 at the lower ends of the rotary shafts 2 and 3, as is clear from FIG. 1. The output pulses from the rotary encoders 8 and 9 are compared with command pulses (target values) set for a virtual rotor and the deviation between the target value and each output value (rotational speed, rotational angle) from the shafts 2 and 3 is processed by a phase difference counter. In consequence, the rotation of the servo motors 6 and 7 is controlled to remove this deviation.

Figure 6:
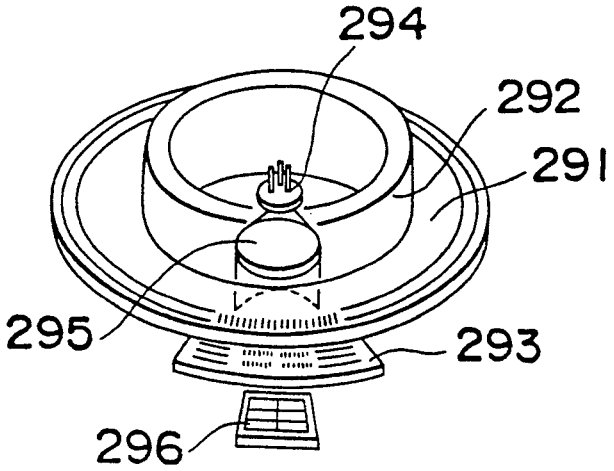
FIG. 6 is a perspective view showing a laser encoder used in the first embodiment.

A magnetic encoder or a general optical encoder may be used as the above rotary encoder. A laser type encoder having high resolution and high speed response utilizing the diffraction/interference of laser beams is used in the instant embodiment. FIG. 6 shows an example of the laser type encoder. In FIG. 6, reference numeral 291 represents a moving slit plate having many slits arranged in the shape of a circle. The moving slit plate 291 is rotated by a shaft 292 such as the first rotary shaft 2 or the second rotary shaft 3. Reference numeral 293 indicates a fixed slit plate, opposed to the moving slit plate 291, where slits are arranged in the configuration of a fan. The light emitted from a laser diode 294 passes through each slit of the slit plates 29 and 293 through a collimator lens 295 and received by a light receiving element 296.

Figure 8:
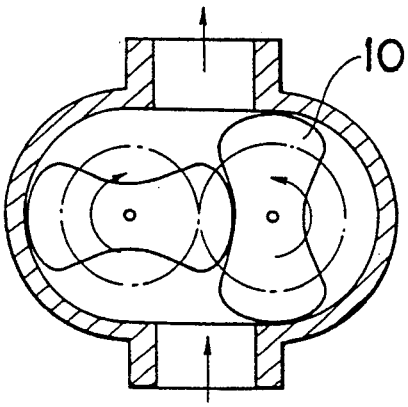
FIG. 8 is a schematic view of a rotor of a different model to be used in the present invention.
Figure 9A:
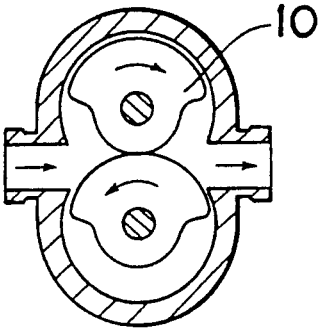
FIGS. 9A and 9B are schematic views of rotors of still different models to be used in the present invention.
Figure 10:
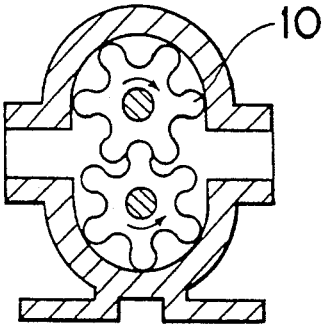
FIG. 10 is a schematic view of a rotor of a further different model to be used in the present invention.
Figure 9B:
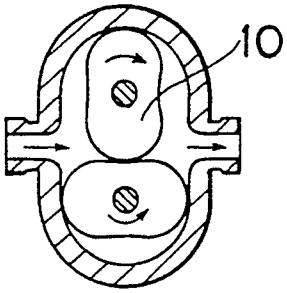
Figure 11:
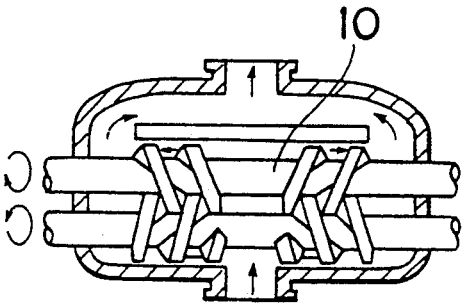
FIG. 11 is a schematic view of a rotor of a yet different model to be used in the present invention.
Figure 12:
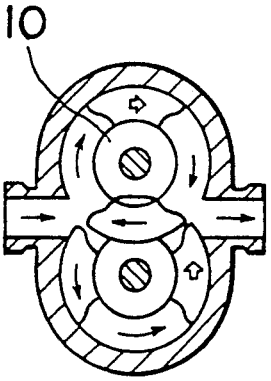
FIG. 12 is a schematic view of a rotor of a yet further model to be used in the present invention.
Figure 13:
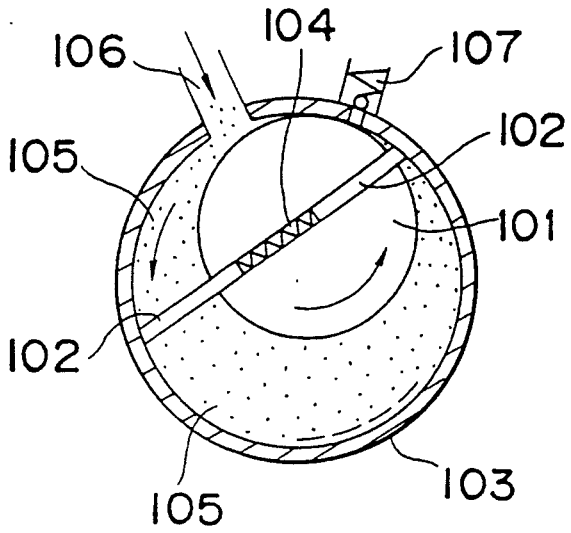
Fig. 13 PRIOR ART
FIG. 13 is a top sectional view of a conventional pump.

The fluid rotating apparatus embodied by the present invention may be a compressor for air conditioning. In this case, a rotor 10 of the rotary section of the compressor may be a Roots-type rotor as indicated in FIG. 8, a gear-type rotor of FIG. 10, a single or double lobe-type rotor of FIGS. 9A and 9B, a screw-type of FIG. 11 or an outer peripheral piston-type of FIG. 12, etc.

Since the synchronous rotation of the rotors is electronically controlled to be contactless according to the present invention, a timing gear used in a conventional screw pump or the like is dispensed with. Moreover, since the rotors are driven separately by independent motors, the transmission of power via a gear is not required. Meanwhile, it is necessary to form a closed space which changes in capacity upon relative movement of two or more rotors in a positive displacement type pump or compressor. Therefore, in the prior art, the two or more rotors are synchronously rotated by a transmission gear, a timing gear, or a complicated transmission mechanism employing a link and a cam mechanism. Although it is possible to rotate the rotors at some high speeds if a lubricating oil is supplied to the timing gear or transmission mechanism, the upper limit of the rotating speed is ten thousand rotations per minute (rpm's) at most when the vibration, noises, and reliability of the apparatus are taken into consideration. In contrast, according to the present invention without requiring a complicated mechanism as in the prior art, the rotary section of the rotors can be rotated at such high speeds as not lower than ten thousands (rpm's) and moreover, the apparatus can be simplified since the transmission mechanism, etc. is omitted. At the same time, no oil seal is necessary and no loss of torque due to mechanical sliding is brought about, thus making it unnecessary to regularly replace the oil seal and oil. The power of the vacuum pump is a product of the torque and the rotating speed, and therefore the torque can be reduced as the rotating speed is increased. Accordingly, the torque can be lowered in the present invention since the rotors are rotated at high speeds, whereby the motor can be made compact. Besides, the rotors are driven by independent motors, and the torque for each motor can be further reduced. When each motor is built in the rotor as in the first embodiment, the apparatus can be compact in size and light in weight, and requires less space as a whole.

In addition, the pump according to the present invention has the centrifugal element type pump disposed on the upstream side of the displacement type vacuum pump. Consequently, unlike the conventional displacement type vacuum pump or the turbo type vacuum pump, the vacuum pump according to the present invention has the following advantages:

(1) The pump can be operated in a wide range of vacuum, namely, the ultimate vacuum is obtained at a degree as high as approximately $10^{-5}$ torr or more.

(2) The discharge performance does not deteriorate in a low degree of vacuum close to atmospheric pressure, unlike the turbo type pump, and thus is as efficient as the conventional displacement type pump.

Figure 4:
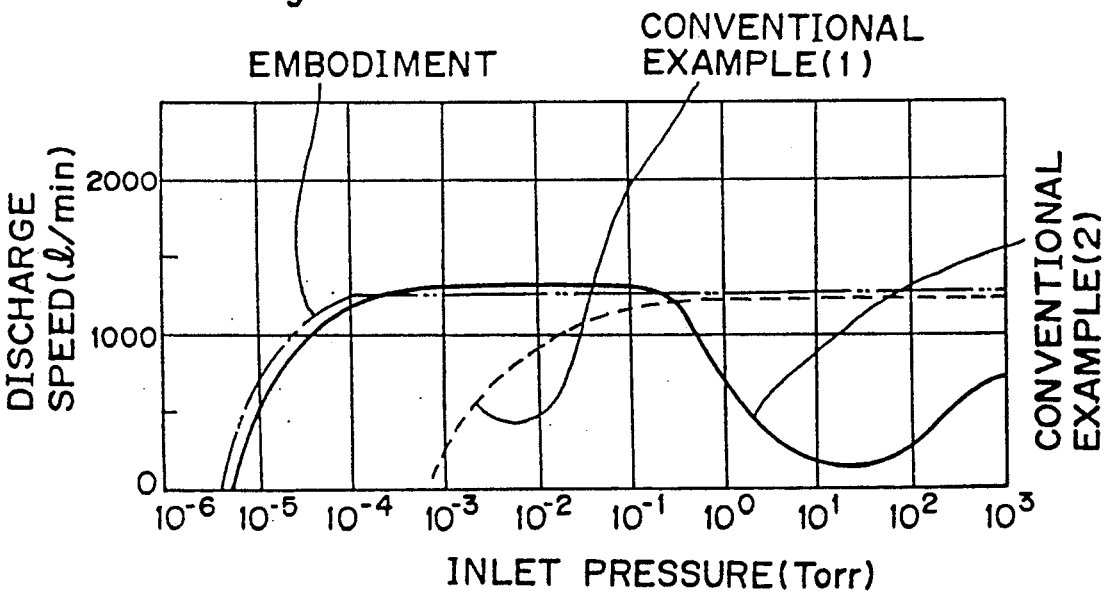
FIG. 4 is a graph showing characteristic data showing the relationship between discharge speed and inlet pressure.
Figure 14:
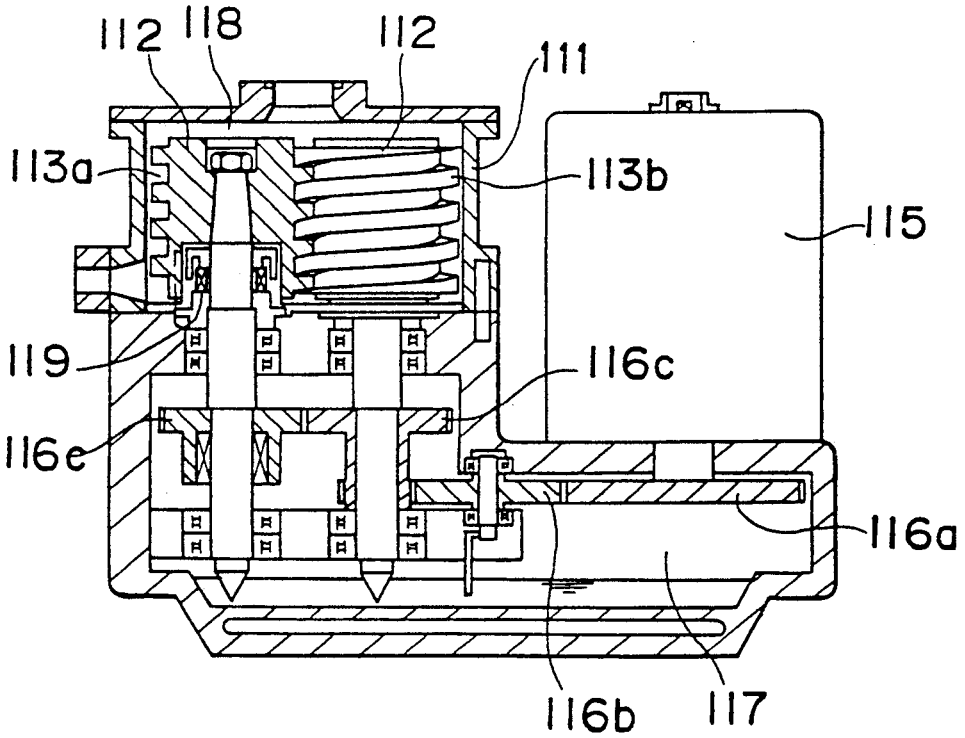
Fig. 14 PRIOR ART
FIG. 14 is a side sectional view of a conventional example (1) of a pump.
Figure 15:
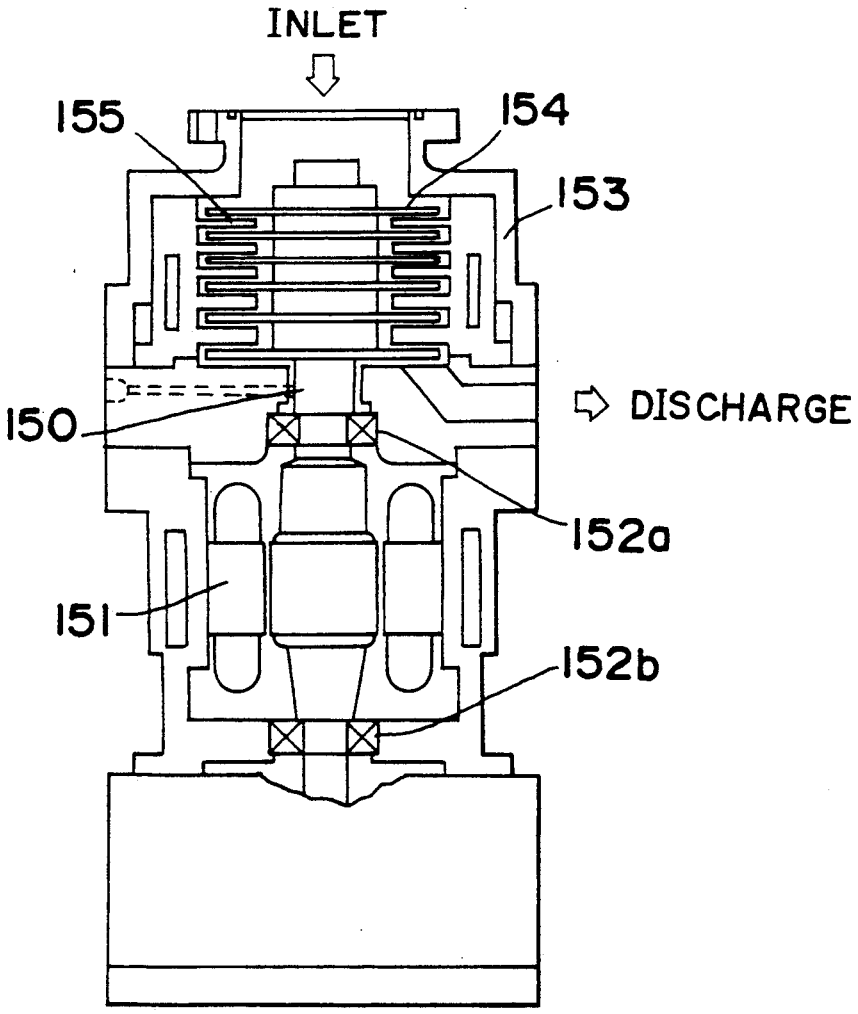
Fig. 15 PRIOR ART
FIG. 15 is a side sectional view of a conventional example (2) of a pump.

The graphs of FIG. 4 show an example of the characteristic data of the discharge speed with respect to the inlet pressure according to the pump of the first embodiment of the present invention, the conventional pump shown in FIG. 14 (displacement type screw pump) shown by the conventional example (1), and the conventional pump in FIG. 15 (turbo type) shown by a conventional example (2). According to the pump of the first embodiment of the present invention, the discharge speed is constant in the range from the atmospheric pressure to $10^{-4}$ torr while according to the turbo type pump, the discharge speed drops in the range from a low degree of vacuum to an intermediate degree of vacuum ($10^{-3}$ to $10^{0}$ torr).

Figure 3B:
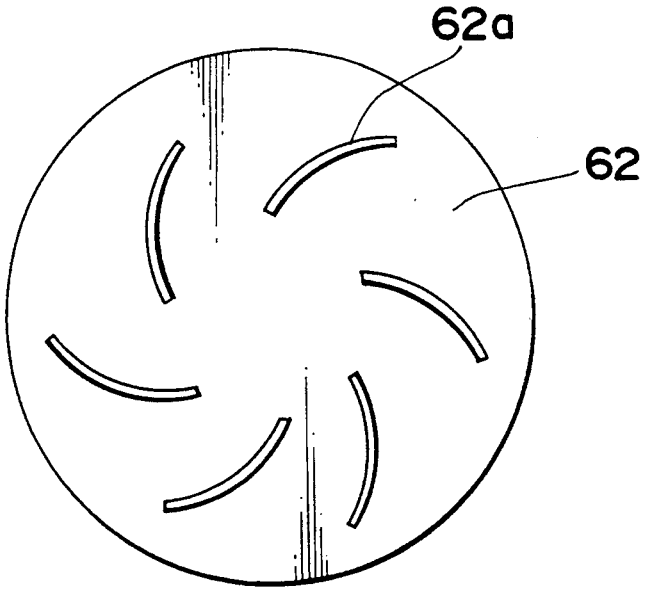
FIG. 3B is a plan view showing a modified spiral groove according to the present invention.

In the centrifugal element type pump according to the first embodiment, a spiral groove is formed on each of the flat surfaces of the rotary disks so that fluid or gas molecules are transported in a radial direction of the rotary shaft 2, i.e., a direction from the outside to the center of the rotary shaft 2 or vice versa in the radial direction, under pressure between the surfaces of the rotary and fixed disks. The spiral groove can be formed on only one of the surfaces of the rotary disk. Alternatively, a spiral groove can be formed on either of the surfaces of the rotary disk or the opposing surface of the fixed disk. Also, the centrifugal element type pump can include only one rotary disk and two fixed disks to hold the rotary disk therebetween via small gaps. In addition, a turbo type centrifugal vane in which fluid flows in the radial direction of the rotary disk, for example, an open impeller having the drag operation can obtain the same advantages as the centrifugal element type pump of the present invention. As one example, FIG. 3B shows projections 62*a* of the above type vane to form spiral grooves between the projections 62*a*.

The screw groove type pump utilizes a drag operation. However, in order to perform a high speed rotation, it is necessary to make the total length of the conventional screw groove type pump longer, thus increasing its natural frequency. As a result, it is impossible to obtain a high speed rotation. On the other hand, the pump of the embodiment of the present invention employs the centrifugal element type pump, not the screw groove type pump which also utilizes the drag operation, because the total length $L_2$ of the entire pump and the total length $L_1$ of the upper portion thereof in FIG. 1 can be shortened by the use of the centrifugal element type pump as compared with the use of the screw groove type pump. As a result, the highspeed operation of the pump can be achieved and the ultimate vacuum can be lowered. The centrifugal element type pump may be provided on the shaft of each of the two rotors. In this case, the pump has a more favorable performance.

Preferably, the rotors may be provided with a screw on the periphery thereof in the structural portion of the positive displacement type vacuum pump because the screw type rotor allows working fluid to flow almost continuously. As a result, the fluctuation of torque applied to the motor of each shaft becomes small. On the other hand, in the Roots-type vacuum pump, the working fluid gives rise to a great pulsating flow in the discharge thereof per rotation of the rotor. The fluctuation of torque caused by the pulsating flow prevents the shafts from rotating synchronously. In the embodiment of the present invention, the adoption of the screw type rotor makes it easy to control the synchronous rotation of the shafts with high speed and accuracy. In the screw type rotor, since the space between the suction side and the discharge side is closed by the recess-projection engagement between the fixed disks and the rotary disks, the influence of the internal leakage of fluid is small and thus a high ultimate vacuum can be obtained.

In the screw type rotor, the sectional configuration of the rotor at right angles with the shaft thereof is similar to a circle, unlike a gear type rotor or a Roots-type rotor. Therefore, a cavity can be formed in a large space in the rotor in the range from the center thereof toward the vicinity of the periphery thereof. The cavity can be utilized as a space for accommodating bearing sections as embodied in the embodiment of the present invention, which contributes to the miniaturization of the apparatus.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A fluid rotating apparatus of a positive displacement type pump, comprising:

a housing having a suction port and a discharge port formed therein;

a plurality of rotors accommodated in said housing;

bearings for rotatably supporting said rotors, respectively;

a plurality of motors for individually rotating said rotors;

a detecting means for detecting rotating angles and rotating speeds of said motors;

a synchronous control means for controlling rotation of said plurality of motors in dependence on a signal from said detecting means; and a transporting means for transporting fluid in a radial direction of one of said rotors, said transporting means comprising a rotary disk mounted coaxially with said one of said rotors so as to be rotatable together with said one of said rotors, and a fixed disk fixed to said housing such that one surface of said rotatable disk is opposed to one surface of said fixed disk, at least one of said one surface of said rotatable disk and said one surface of said fixed disk having spiral grooves formed therein which rotate relative to other of said one surface of said rotary disk and said one surface of said fixed disk upon rotation of said one of said rotors.

2. A fluid rotating apparatus as recited in claim 1, wherein each of said rotors has spiral grooves formed in its outer peripheral surface.

3. A fluid rotating apparatus as recited in claim 1, wherein said transporting means is operable to transport the fluid from said suction port and toward an inlet into said space defined by said housing and said rotors.

4. A fluid rotating apparatus of a positive displacement type pump, comprising:

a housing having a suction port and a discharge port formed therein;

a plurality of rotors accommodated in said housing;

bearings for rotatably supporting said rotors, respectively;

a plurality of motors for individually rotating said rotors;

a detecting means for detecting rotating angles and rotating speeds of said motors;

a synchronous control means for controlling rotation of said plurality of motors in dependence on a signal from said detecting means; and a transporting means for transporting fluid in a radial direction of one of said rotors, said transporting means comprising a rotary disk mounted coaxially with said one of said rotors so as to be rotatable together with said one of said rotors, a fixed disk fixed to said housing such that one surface of said rotatable disk is opposed to one surface of said fixed disk, and a plurality of turbo type centrifugal vanes protruding from at least one of said one surface of said rotary disk and said one surface of said fixed disk, said vanes being rotatable relative to the other of said one surface of said rotary disk and said one surface of said fixed disk upon rotation of said one of said rotors.

5. A fluid rotating apparatus as recited in claim 4, wherein each of said rotors has spiral grooves formed in its outer peripheral surface.

6. A fluid rotating apparatus as recited in claim 4, wherein said transporting means is operable to transport the fluid from said suction port and toward an inlet into said space defined by said housing and said rotors.

* * * * *